US006607649B2

(12) United States Patent
Schatton et al.

(10) Patent No.: US 6,607,649 B2
(45) Date of Patent: Aug. 19, 2003

(54) PROCESS OF PREVENTING STRAY CURRENTS IN PERIPHERAL PARTS OF A PLANT IN AN ELECTROLYSIS

(75) Inventors: Helmut Schatton, Lünen (DE); Nikola Anastasijevic, Altenstadt (DE)

(73) Assignee: MG Technologies AG, Frankfurt am Main (DE)

( * ) Notice: Subject to any disclaimer, the term of this patent is extended or adjusted under 35 U.S.C. 154(b) by 56 days.

(21) Appl. No.: 10/010,327

(22) Filed: Nov. 8, 2001

(65) Prior Publication Data

US 2002/0060158 A1 May 23, 2002

(30) Foreign Application Priority Data

Nov. 21, 2000 (DE) ..... 100 57 707

(51) Int. Cl.[7] ..... C25B 15/08

(52) U.S. Cl. ..... 205/80; 205/96; 205/98; 205/334; 205/349; 205/640; 205/687; 204/237; 204/275.1

(58) Field of Search ..... 205/80, 96, 98, 205/334, 349, 351, 640, 687; 204/237, 255, 263, 269, 275.1, DIG. 7

(56) References Cited

U.S. PATENT DOCUMENTS 2,673,232 A 3/1954 Silsby, Jr.
4,032,424 A * 6/1977 Peters et al. ..... 204/258
4,194,953 A * 3/1980 Hatherly ..... 204/95
4,713,160 A * 12/1987 Moreland ..... 204/231
4,925,539 A * 5/1990 Francois ..... 204/146

FOREIGN PATENT DOCUMENTS

EP 0 033 586 8/1981
GB 2 161 316 1/1986

* cited by examiner

*Primary Examiner*—Roy King
*Assistant Examiner*—William T. Leader
(74) *Attorney, Agent, or Firm*—Herbert Dubno

(57) ABSTRACT

An electrolyte line extends from the outlet of an electrolysis device to a collecting tank and from the same back to the inlet of the electrolysis device. The electrolyte is passed from the outlet of the electrolysis device to a first container which is disposed at a higher level than a second container. Electrolyte collected in the first container is periodically discharged through a first syphon line into the second container, and electrolyte collected in the second container is periodically discharged through a second syphon line into the collecting tank which is disposed at a lower level than the second container. The outlet end of each syphon line is disposed at a distance above the liquid level of the container disposed thereunder, so that electrolyte always flows only in one of the two syphon lines or in none of the syphon lines. When electrolyte flows in none of the two syphon lines, electrolyte is preferably supplied from the collecting tank into the second container.

2 Claims, 1 Drawing Sheet

Figure 1:
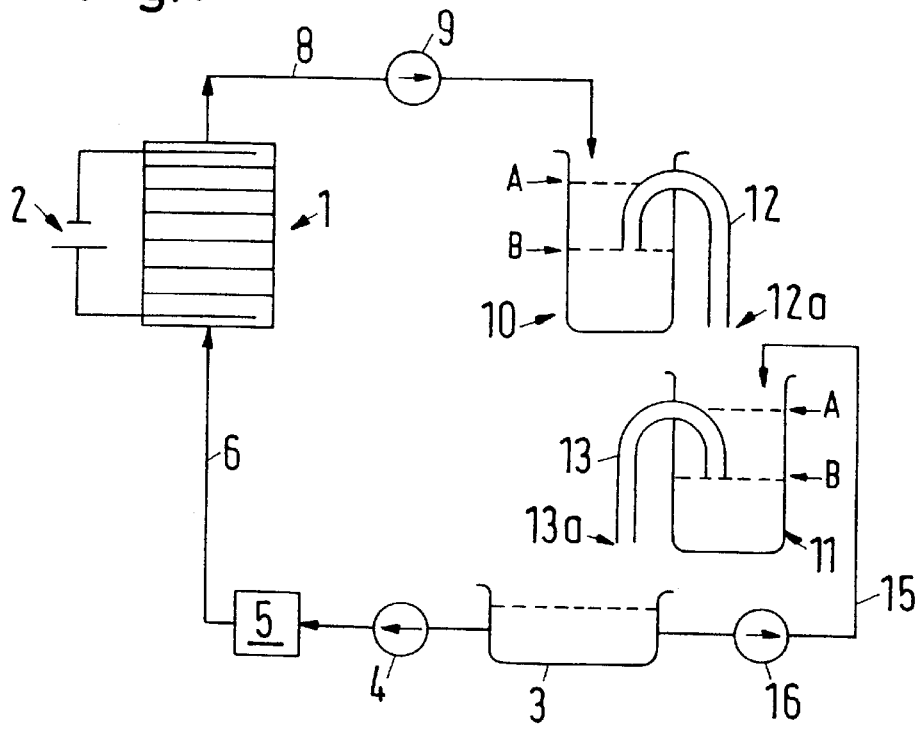

PROCESS OF PREVENTING STRAY CURRENTS IN PERIPHERAL PARTS OF A PLANT IN AN ELECTROLYSIS

DESCRIPTION

This invention relates to a process of preventing stray currents in peripheral parts of a plant in an electrolysis, wherein an electrolyte line extends from the outlet of an electrolysis device to a collecting tank and from the same back to the inlet of the electrolysis device. Usually, the difference of the electric d.c. voltage between the electrolyte outlet line and the line leading to the inlet is at least 3 V and preferably at least 10 V.

In electrolysis plants, a so-called stray current flows through the electrolyte supply line and the electrolyte discharge line, outside the actual electrolysis device. This stray current causes an increased consumption of energy, and it may lead to corrosion problems in the peripheral parts of the plant, e.g. in the reservoir, in the electrolyte conditioning and in a usually present electrolyte preheater. Would the supply line and/or the discharge line be grounded, metal deposits in the line would occur in the vicinity of the grounding terminal, if it is a metal recovery or metal coating process (electroplating).

It is the object underlying the invention to simply and reliably prevent the current flowing through the supply line and the discharge line, so that even with relatively high electric voltages in the electrolysis device stray currents in the peripheral parts of the plant outside the electrolysis device are avoided. In accordance with the invention this is achieved in that the electrolyte is supplied from the outlet of the electrolysis device to a first container which is disposed at a higher level than a second container, that electrolyte collected in the first container is periodically discharged through a first syphon line into the second container, that electrolyte collected in the second container is periodically discharged through a second syphon line into a collecting tank which is disposed at a lower level than the second container, that the outlet end of each syphon line is disposed at a distance above the liquid level of the container disposed thereunder, and that electrolyte always flows only in one of the two syphon lines or in none of the syphon lines. This leads to the permanent interruption of the current flow in the peripheral region between the outlet and the inlet of the electrolysis plant. If instead a switching of valves would be employed, small amounts of electrolyte wetting the walls inside the valve could already lead to a disturbing electrical conductivity.

The process can be employed in various types of electrolysis plants, which are used e.g. for metal recovery, metal refining, electrosynthesis or electroplating.

Details of the process are explained by means of the electrolysis plant schematically represented in the drawing, in which:

FIG. 1 shows a flow diagram of the process, and

Figure 2:
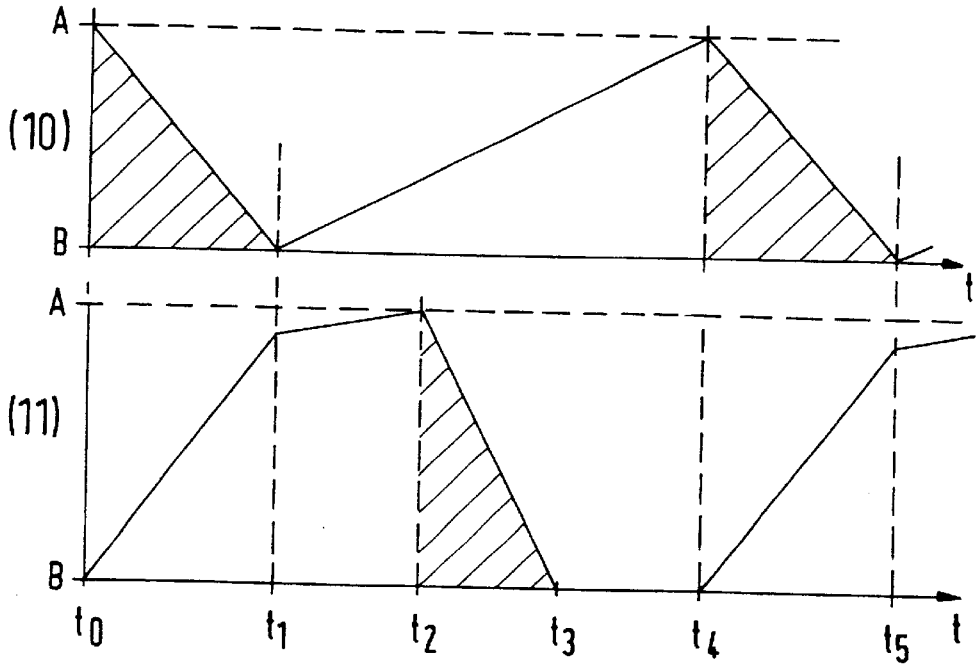

FIG. 2 schematically shows the rise and fall of the filling level in the first and second containers.

The electrolysis plant of FIG. 1 comprises an electrolysis device (1) with a voltage source (2) for direct electric current. Electrolyte comes from the reservoir (3) and is supplied through the pump (4) to a preheater (5), before it enters the electrolysis device (1) through the supply line (6). The electrolysis device may include e.g. one or more electrolytic cells.

Used electrolyte leaves the device (1) through the discharge line (8) and is usually continuously supplied through the pump (9) into a first container (10). The first container (10) is disposed at a higher level than a second container (11), so that electrolyte from the container (10) can periodically be discharged through a syphon line (12) into the second container (11). From the second container, the electrolyte periodically flows through the syphon line (13) thereof back into the reservoir (3). A certain amount of used electrolyte is removed from the process, and fresh electrolyte is supplied, which is, however, not represented for simplification. The outlet end **(12*a*) or (13*a*) is located at a lower level than the respective inlet opening of line (12, 13)**.

Each of the two containers (10) and (11) has an upper filling level (A) for the electrolyte, at which the electrolyte starts to flow off to the outside and downwards through the respective syphon line (12) or (13). Due to the viscosity of the liquid and the influence of gravity, the electrolyte flows until filling level (B) is reached, where line (12) or (13) no longer is immersed in the electrolyte.

It is ensured that electrolyte always flows only in one of the two syphon lines or in none of the syphon lines (12, 13). Details will be explained below in conjunction with FIG. 2. To make electrolyte from line (13) flow when the flow through line (12) is interrupted, a small amount of electrolyte is occasionally supplied from the reservoir (3) through a return line (15) with appropriately controlled pump (16) into the container (11), in order to raise the filling level at least up to the level (A). This is effected when electrolyte flows in none of the two syphon lines. Usually it is ensured that due to the electrolyte flow through the syphon line (13) the filling level in the second container (11) is reduced more quickly than the filling level in the first container (10) rises due to the inflow of the electrolyte coming from line (8). There is thus obtained a relatively long period during which no electrolyte flows through line (12).

EXAMPLE

In a laboratory apparatus, which is operated as shown in FIG. 1, the electrolysis device has been replaced by a water reservoir. Through line (8), 60 l/h water continuously flow to the container (10), the syphon line (12) has an inside diameter of 10 mm, and the inside diameter of the syphon line (13) is 12 mm. The variation of the filling levels in the containers (10) and (11) in time between the maximum (A) and the minimum (B) is represented in FIG. 2; t is the time axis.

The container (10) takes a maximum of 1 liter; together with the amount simultaneously flowing in from the water reservoir, the filling level in the container (10) is reduced over 26 seconds from the maximum (A) to the minimum (B), which in FIG. 2 is the period between $t_0$ and $t_1$. The amount of water flowing into the second container (11) is not sufficient to initiate a discharge through line (13). This requires in addition an amount of water supplied by the pump (16) and coming from the collecting tank (3) during the period between $t_1$ and $t_2$. There is thus achieved the filling level (A) in the container (11), so that the discharge through line (13) is possible. During a period of 18 seconds, between the points $t_2$ and $t_3$, the filling level in the container (11) falls from (A) to (B). Between the points $t_3$ and $t_4$ water flows neither in line (12) nor in line (13). Then, from point $t_4$ onwards, the filling level in the container (10) has again reached the level (A), and liquid flows again through line (12) into the container (11). The explained up and down of the filling levels now starts anew, point $t_5$ corresponding to point $t_1$. The hatched areas indicate that liquid flows in one of lines (12) or (13), whereby an electrically conductive connection with the container disposed thereunder has been made. Since the flow through both lines never takes place at the same time, a flow of electric current between line (8) and line (6), cf. FIG. 1, is made impossible.

What is claimed is:

1. A process of preventing stray currents in peripheral parts of a plant in an electrolysis, wherein an electrolyte line extends from the outlet of an electrolysis device to a collecting tank and from the same back to the inlet of the electrolysis device, characterized in that the electrolyte is supplied from the outlet of the electrolysis device to a first container which is disposed at a higher level than a second container, that electrolyte collected in the first container is periodically discharged through a first syphon line into the second container, that electrolyte collected in the second container is periodically discharged through a second syphon line into the collecting tank which is disposed at a lower level than the second container, that the outlet end of each syphon line is disposed at a distance above the liquid level of the container disposed thereunder, and that electrolyte always flows only in one of the two syphon lines or in none of the syphon lines.

2. The process as claimed in claim 1, characterized in that when electrolyte flows in none of the two syphon lines, electrolyte is supplied from the collecting tank into the second container.

* * * * *